US007245283B2

(12) United States Patent
Kim et al.

(10) Patent No.: US 7,245,283 B2
(45) Date of Patent: Jul. 17, 2007

(54) LCD SOURCE DRIVING CIRCUIT HAVING REDUCED STRUCTURE INCLUDING MULTIPLEXING-LATCH CIRCUITS

(75) Inventors: Do-Kyung Kim, Suwon (KR); Yong-Weon Jeon, Suwon (KR)

(73) Assignee: Samsung Electronics Co., Ltd. (KR)

( * ) Notice: Subject to any disclaimer, the term of this patent is extended or adjusted under 35 U.S.C. 154(b) by 549 days.

(21) Appl. No.: 10/782,168

(22) Filed: Feb. 19, 2004

(65) Prior Publication Data

US 2004/0164941 A1 Aug. 26, 2004

(30) Foreign Application Priority Data

Feb. 22, 2003 (KR) ..... 10-2003-0011208

(51) Int. Cl.
*G09G 3/36* (2006.01)

(52) U.S. Cl. ..... 345/100; 345/87; 345/88; 345/89; 345/92

(58) Field of Classification Search ..... 345/87–100, 345/58, 55, 204, 60, 63, 690, 691, 692, 208–213, 345/147, 51, 613; 323/280, 281; 330/130, 330/133

See application file for complete search history.

(56) References Cited

U.S. PATENT DOCUMENTS 4,388,696 A * 6/1983 Test et al. ..... 345/87
4,917,468 A * 4/1990 Matsuhashi et al. ..... 345/92
5,420,600 A * 5/1995 Strobel et al. ..... 345/51
5,874,931 A * 2/1999 Drake et al. ..... 345/51
6,008,801 A 12/1999 Jeong
6,320,572 B1 * 11/2001 Takabayashi et al. ..... 345/204
6,429,858 B1 * 8/2002 Janssen et al. ..... 345/204
6,492,970 B1 * 12/2002 Furuhashi et al. ..... 345/94
6,806,859 B1 * 10/2004 Kanoh et al. ..... 345/98
6,947,022 B2 * 9/2005 McCartney ..... 345/99
6,989,824 B1 * 1/2006 Ishii et al. ..... 345/204
7,068,287 B2 * 6/2006 Credelle ..... 345/613
7,119,802 B2 * 10/2006 Suyama et al. ..... 345/208
2002/0000964 A1 * 1/2002 Sumiya ..... 345/87
2002/0030649 A1 * 3/2002 Zavracky et al. ..... 345/87
2002/0093475 A1 * 7/2002 Hashimoto ..... 345/87
2003/0034942 A1 * 2/2003 Tjandra et al. ..... 345/87
2003/0151581 A1 * 8/2003 Suyama et al. ..... 345/98
2004/0160398 A1 * 8/2004 Yokota et al. ..... 345/87
2004/0196231 A1 * 10/2004 Goto et al. ..... 345/87

* cited by examiner

*Primary Examiner*—Bipin Shalwala
*Assistant Examiner*—Prabodh Dharia
(74) *Attorney, Agent, or Firm*—F. Chau & Associates, LLC

(57) ABSTRACT

A liquid crystal display (LCD) source driving circuit having a reduced circuit footprint. A plurality of the LCD source driving circuits are typically disposed along a side of an LCD panel and drives the LCD panel in response to digital image signals, such as color signals R, G, B, and control signals received from a control circuit. Also, the LCD source driving circuit includes a plurality of latch circuits, a plurality of level shifters, a plurality of Positive voltage digital-to-analog decoders, a plurality of Negative voltage digital-to-analog decoders, a plurality of multiplexor (MUX) circuits, and a plurality of amplifiers. Thus, the LCD source driving circuit is capable of selectively latching digital image signals using the latch circuits with MUX circuit functions, thereby reducing the circuit footprint of source vertical channels within the LCD source driving circuit.

16 Claims, 5 Drawing Sheets

LCD SOURCE DRIVING CIRCUIT HAVING REDUCED STRUCTURE INCLUDING MULTIPLEXING-LATCH CIRCUITS

BACKGROUND OF THE INVENTION

1. Field of the Invention

The present invention relates to a source driving circuit for a liquid crystal display (LCD), and more particularly, to a Thin Film Transistor (TFT) LCD source driving circuit which has a digital to analog converter 2. Description of the Related Art A TFT-LCD source driver is a circuit that supplies video signals to an LCD pixel array. Digital video signals are inputted to the TFT-LCD source driver, and the source driver latches the digital video signals and outputs analog R, G, B component signals. Each color signal is digitized as 6 bits, and accordingly the total digital video signal is composed of 18 bits. In general, a liquid crystal display (LCD) includes a TFT-LCD panel 11, a gate driving circuit 12, a source driving circuit 13, and a control circuit 14, as shown in FIG. 1. The LCD panel 11 is a switching device in which pixels using thin film transistors (TFFs) are arranged in a matrix format. A plurality of source driving circuits 13 are arranged along the LCD panel 11 in rows and a plurality of gate driving circuits 12 are arranged along the LCD panel 11 in columns. The control circuit 14 transmits a clock signal CLK to the plurality of gate driving circuits 12 in parallel and transmits a vertical synchronization signal CLD to the one of the plurality of gate driving circuits 12 that is proximate to the control circuit 14.

Also, the control circuit 14 transmits the clock signal CLK, a digital image signals R, G, B, a latch signal CLA, and a polarity signal POL to the plurality of source driving circuits 13, and transmits a start pulse signal SP to the one of the plurality of source driving circuits 13 that is proximate to the control circuit 14.

The gate driving circuit 12 applies a first predetermined bias voltage to the TFT of the LCD panel 11 so as to turn on the TFT. While the TFT is turned on, the pixels are filled with electric charges when predetermined driving voltages are applied by the source driving circuits 13.

Next, the gate driving circuit 12 applies a second predetermined bias voltage to the LCD panel 11, the TFT is turned off and electric charges filled in the pixels are maintained.

The LCD panel 11 consists of 1024×768 pixels. If the LCD panel 11 is a color eXtended Graphics Array (XGA), eight or ten source driving circuits capable of outputting 384 signals are required.

An example of a conventional source driving circuit is disclosed in U.S. Pat. No. 6,008,801. Such a conventional source driving circuit will now be in a greater detail described with reference to FIGS. 2 and 3.

FIG. 2 is a block diagram illustrating a conventional source driving circuit 100 for an LCD. The conventional source driving circuit 100 includes a shift register unit 101, a latch circuit unit 102, a first multiplexor (MUX) circuit unit 103, a level shifter unit 104, a decoding unit 105, a second MUX circuit unit 106, and an amplifying unit 107.

The shift register unit 101 includes a plurality of shift registers SL1 through SLK, and receives a latch signal CLA from the control circuit 14 of FIG. 1 and outputs a plurality of latch signals EN1 through EN2K (K is a natural number more than 1).

The latch circuit unit 102 includes a plurality of latch circuits LA1 through LA3K and latches a digital image signal in response to the plurality of latch signals EN1 through EN2K. The digital image signal is an 18-bit digital data signal that contains six-bit signals R, G, B.

The level shifter unit 104 includes a plurality of level shifters LS1 through LS3K, and increases the voltage levels of the latched signals R, G, B and outputs the signals R, G, B so that the voltage levels fall within a range of voltage levels that can be recognized by the decoding unit 105.

The decoding unit 105 includes a plurality of first decoders PD1 through PD2K and a plurality of second decoders ND1 through ND2K. 64-level first reference voltages (not shown) having positive (+) polarities are applied to the plurality of first decoders PD1 through PD2K and 64-level second reference voltages (not shown) having negative (−) polarities are applied to the plurality of second decoders ND1 through ND2K.

The plurality of first decoders PD1 through PD2K selects and outputs one of the 64-level first reference voltages having positive (+) polarities, in response to the signals R, G, B. The plurality of second decoders ND1 through ND2K selects and outputs one of the 64-level second reference voltages having negative (−) polarities, in response to the signals R, G, B. As a result, analog image signals R1G1B1 through RKGKBK are output from the first decoders PD1 through PD2K and the second decoders ND1 through ND2K.

The amplifying unit 107 includes a plurality of amplifier circuits A1 through A3K. The plurality of amplifier circuits A1 through A3K increase the amount of electric currents and output the analog image signals R1G1B1 through RKGKBK while maintaining the voltage levels of these signals.

In FIG. 2, as shown in dotted line blocks C and D, the polarities of the analog image signals R1G1B1 through RKGKBK that are finally output from the source driving circuit 100 must be alternately changed.

The reason for alternately changing the polarities of these analog images is to prevent low mobility of the liquid crystal in the LCD panel 11 of FIG. 1. For instance, the mobility of the liquid crystal in the LCD panel 11 is degraded when first voltages having the same polarities are continuously applied to the LCD panel 11. The low mobility of the liquid crystal causes the liquid crystal not to respond when second voltages whose levels are different from those of the first voltages are applied to the LCD panel 11. To solve this problem, the source driving circuit 100 outputs the analog image signals R1+G1−B1+ through RK−GK+BK− illustrated in the dotted line block C, or outputs the analog image signals R1−G1+B1− through RK+GK−BK+ illustrated in the dotted line block D, in response to a polarity signal POL output from the control circuit 14.

The analog image signals R1G1B1 through RKGKBK must be output from the source driving circuit 100 in the sequence of a signal R, a signal G, and a signal B as illustrated in the dotted line blocks C and D.

The first MUX circuit unit 103 and the second MUX circuit unit 106 are installed in the source driving circuit 100 to output the analog image signals R1G1B1 through RKGKBK in the sequence of the signal R, the signal G, and the signal B while alternately changing the polarities of these analog image signals.

The first MUX circuit unit 103 includes a plurality of MUX circuits M1 through M3K and the second MUX circuit unit 106 includes a plurality of MUX circuits DM1 through DM3K.

The structures and operations of the first MUX circuit unit 103 and the latch circuit unit 102 will now be described with reference to FIG. 3.

FIG. 3 illustrates the relationship between the MUX circuits M1 and M2 and the latch circuits LA1 and LA2 included in two source vertical channels LA1 through A1 and LA2 through A2, shown in FIG. 2, that output an analog image signals R1 and G1, respectively, in response to digital image signals R and G, respectively.

As shown in FIG. 3, the latch circuit LA1 includes a first latch circuit 110 and a second latch circuit 120, which are connected to each other, and the latch circuit LA2 includes a first latch circuit 130 and a second latch circuit 140 which are also connected to each other.

The first latch circuit 110 includes a transmission gate 111 and a latch 112. The latch 112 includes inverters 113 and 114, a PMOS transistor P1, and an NMOS transistor N1. A latch signal EN1 is input to gates of an NMOS transistor of the transmission gate 111 and the PMOS transistor P1 of the latch 112. A latch signal EN1B is input to gates of a PMOS transistor of the transmission gate 111 and the NMOS transistor N1 of the latch 112. The inverters 113 and 114 are connected to the output of transmission gate 111. Also, the source of the PMOS transistor P1 and the drain of the NMOS transistor N1 are connected to the input terminal of the inverter 113, and the drain of the PMOS transistor P1 and the source of the NMOS transistor N1 are connected to the output terminal of the inverter 114.

The structure of the first latch circuit 130 and the second latch circuits 120 and 140 are identical with that of the first latch circuit 110, except that latch signals EN2 and EN2B, instead of the latch signals EN1 and EN1B, are input to the second latch circuits 120 and 140. Thus, their detailed descriptions will be omitted.

The MUX circuit M1 includes two transmission gates 151 and 152 and the MUX circuit M2 also includes two transmission gates 161 and 162. These transmission gates 151, 152, 161, and 162 are turned ON (i.e., conducting) or OFF in response to selection signals SEL and SELB.

The input terminals of the transmission gates 151 and 162 are connected to the output terminal of the second latch circuit 120 (e.g., the output of inverter 124); and the input terminals of the transmission gates 152 and 161 are connected to the output terminal of the second latch circuit 140 (e.g., the output of inverter 144).

The operations of the first and second latch circuits LA1 and LA2 and the MUX circuits M1 and M2 will now be described in a greater detail.

First, the latch signals EN1 and EN1B are enabled and the transmission gates 111 and 131 are turned ON. The transmission gate 111 receives a digital signal R and passes it to latch 112, and the transmission gate 131 receives a digital signal G and passes it to latch 132. Next, the latch signals EN1 and EN1B are disabled and the transmission gates 111 and 131 are turned off.

Also, when the latch signals EN1 and EN1B are disabled, the PMOS transistor P1 and the NMOS transistor N1 of the latch 112 are turned ON and a PMOS transistor P3 and an NMOS transistor N3 of the latch 132 are turned ON, whereupon digital signals R and G are latched (stored) by latches 112 and 132 respectively.

The latch 112 latches and stores the digital signal R and the latch 132 latches and stores the digital signal G.

(When the latch signals EN1 and EN1B are enabled again, the PMOS transistors P1 and P3 and the NMOS transistors N1 and N3 of the latches 112 and 132 are turned OFF and a new value of each of digital signals R and G may be stored in the respective latches.)

Next, when the latch signals EN2 and EN2B are enabled, the transmission gates 121 and 141 are turned ON. The transmission gate 121 outputs the stored digital signal R received from the latch 112 to the latch 122. The transmission gate 141 outputs the stored digital signal G received from the latch 132 to the latch 142.

Thereafter, the latch signals EN2 and EN2B are disabled, and the transmission gates 121 and 141 are turned OFF. When the latch signals EN2 and EN2B are disabled, the PMOS transistors P2 and P4 and the NMOS transistors N2 and N4 of the latches 122 and 142 are turned ON, whereupon digital signals R and G are latched (stored) by latches 120 and 140 respectively. The latch 122 latches and stores the digital signal R and the latch 142 latches and stores the digital signal G.

(When the latch signals EN2 and EN2B are enabled again, the PMOS transistors P2 and P4 and the NMOS transistors N2 and N4 of the latches 122 and 142 are turned OFF, and a new value of each of digital signals R and G may be stored in the respective latches.)

Next, when the control circuit 14 of FIG. 1 outputs a high-level polarity signal POL, the selection signals SEL and SELB are enabled. (SEL is enabled at a high logic voltage level; SELB is enabled at a low logic voltage level) The transmission gates 151 and 161 of the MUX circuits M1 and M2 are turned ON in response to the enabled selection signals SEL and SELB. The transmission gate 151 passes the digital signal R received from the latch 122; and the transmission gate 161 passes the digital signal G received from the latch 142.

If the polarity signal POL is at a low-level, the selection signals SEL and SELB are disabled and the transmission gates 152 and 162 are turned ON. The transmission gate 152 passes the digital signal G received from the latch 142; and the transmission gate 162 passes the digital signal R received from the latch 122.

As described above, the conventional source driving circuit 100 for an LCD requires the first and second MUX circuits 103 and 106 so as to output the analog image signals R1G1B1 through RKGKBK in the sequence of a signal R, a signal G, and a signal B while alternately changing the polarities of these analog image signals from positive (+) to negative (−) and vice versa. The inclusion of the first and second MUX circuits 103 and 106, however, results in an increase in the area (circuit footprint) of the source vertical channels of the source driving circuit 100 and a reduction in the available area of the semiconductor chip that such a source driving circuit 100 is fabricated on.

Further, as is apparent from FIG. 3, the latch signals EN1 and EN1B are applied to the transmission gages 111 and 131 and the latches 112 and 132 at the same time. Since the signals R, G, B each contain 6-bit digital data, and each source vertical channel handles one bit thereof, the latch signals EN1 and EN1B are each required to control the operation of a total of eighteen transmission gates and eighteen latches, thereby increasing loads driven by the latch signals EN1 and EN1B.

SUMMARY OF THE INVENTION

The present invention provides a source driving circuit for a liquid crystal display (LCD) having a reduced circuit area, and that is capable of selecting and latching one of a plurality of digital (image) signals using in each source vertical channel a latch circuit that includes multiplexor (MUX) circuit functions.

A first aspect of the present invention provides a source driving circuit for driving a liquid crystal display (LCD) and that may be disposed along a side of an LCD panel and that drives the LCD panel in response to a plurality of digital image signals (such as N-bit digital color signals R, G, B, where N is a natural number more than 1), and control signals received from a control circuit. The source driving circuit comprises a plurality of source vertical channels. Each of the source vertical channels includes a multiplexing-latch circuit. Each of the multiplexing-latch circuits is adapted to latch one of two received digital color signals in response to selection signals (and latch signals) which are the control signals and outputs one bit of N-bit latched data.

A second aspect of the present invention provides a source driving circuit for a liquid crystal display (LCD) for driving an LCD panel in response to digital image signals, the source driving circuit comprising: first and second multiplexing-latch circuits, wherein each of the multiplexing-latch circuits is adapted to latch a dynamically selected one of a first and second digital image signals dynamically selected in response to first and second selection signals and to output one of the latched first and second digital image signals.

The source driving circuit may further comprise: a plurality of level shifters for increasing logic voltage levels of the latched digital image signal data received from the first and second multiplexing-latch circuits and outputting the level-shifted latched data; a plurality of positive decoders, wherein each of the positive decoders is adapted to output a dynamically selected one of a plurality of positive reference voltages in response to the latched data received from the plurality of level shifters, each of the positive reference voltages having different voltage levels and positive polarities; a plurality of negative decoders, wherein each of the negative decoders is adapted to output a dynamically selected one of a plurality of negative reference voltages in response to the latched data received from the plurality of level shifters, the negative reference voltages having different voltage levels and negative polarities; a plurality of multiplexor (MUX) circuits, wherein each of the MUX circuits is adapted to output a selected one of the positive and negative reference voltages as an analog image signal in response to a MUX selection signal; and a plurality of amplifiers adapted to increase the magnitude of electric current of the analog image signals output at the positive and negative reference voltages.

Another aspect of the invention provides a source driving circuit for a liquid crystal display (LCD) that drives an LCD panel in response to digital image signals, the source driving circuit comprising: a plurality of pairs of first and second multiplexing-latch circuits, wherein each of the first and second multiplexing-latch circuits is adapted to latch a dynamically selected one of a first and second digital image signals dynamically selected in response to first and second selection signals and to output one of the latched first and second digital image signals. Each of the first and second multiplexing-latch circuits may include a master latch circuit and a slave latch circuit. One of the master latch circuit and slave latch circuit comprises a plurality of transmission gates adapted to selectively pass one of a plurality of digital signals to a latch unit within such latch circuit.

Another general aspect of the invention provides for the construction of articles of manufacture comprising: a master-slave latch circuit adapted to dynamically select and to latch one of a first and second externally supplied independent voltage signals and to output one of the first and second voltage signals.

BRIEF DESCRIPTION OF THE DRAWINGS

The above and other aspects and advantages of the present invention will become more apparent by describing in detail-preferred embodiments thereof with reference to the attached drawings in which.

DETAILED DESCRIPTION OF THE INVENTION

Figure 1:
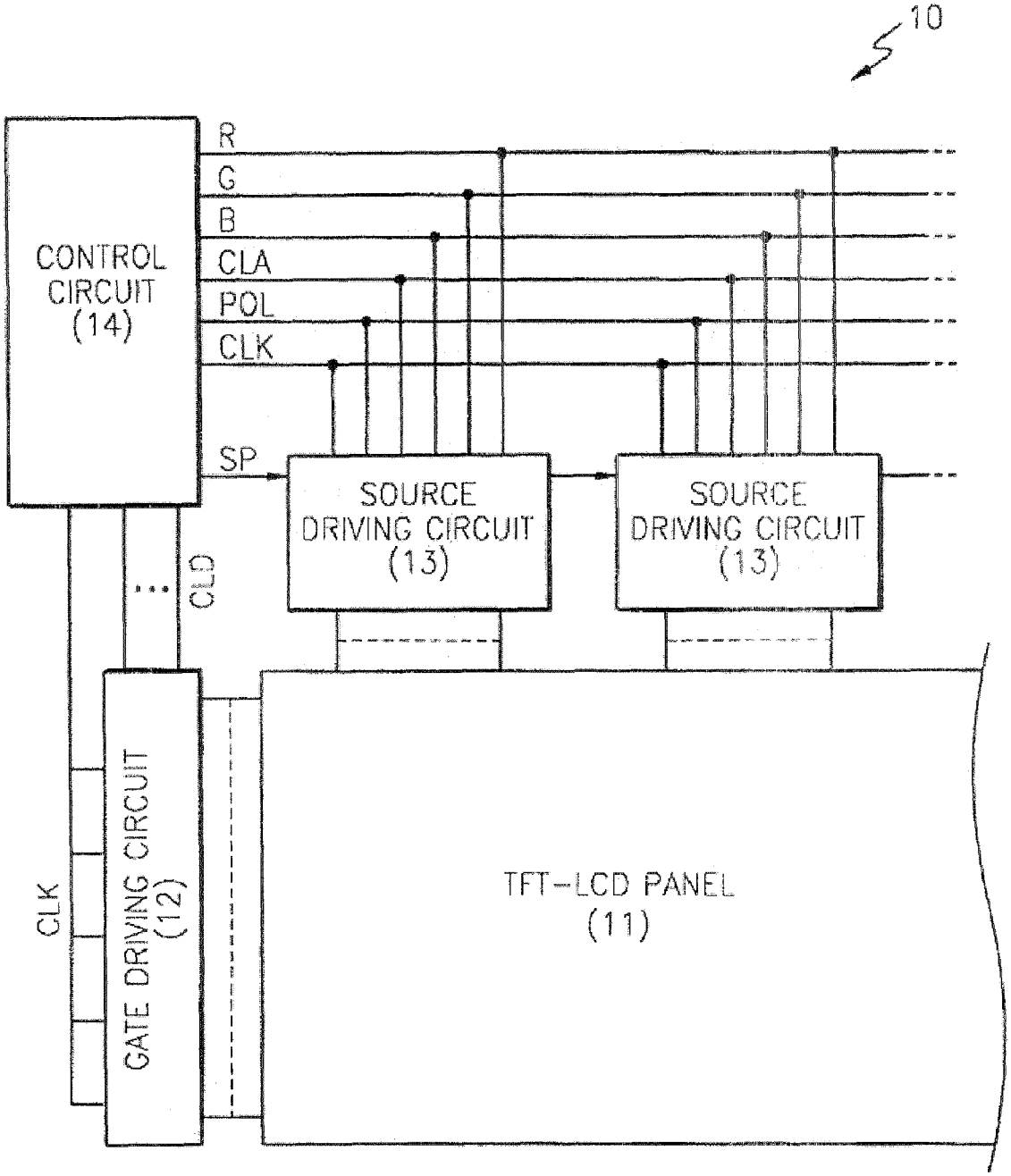
FIG. 1 is a schematic block diagram illustrating a typical liquid crystal display (LCD)
Figure 2:
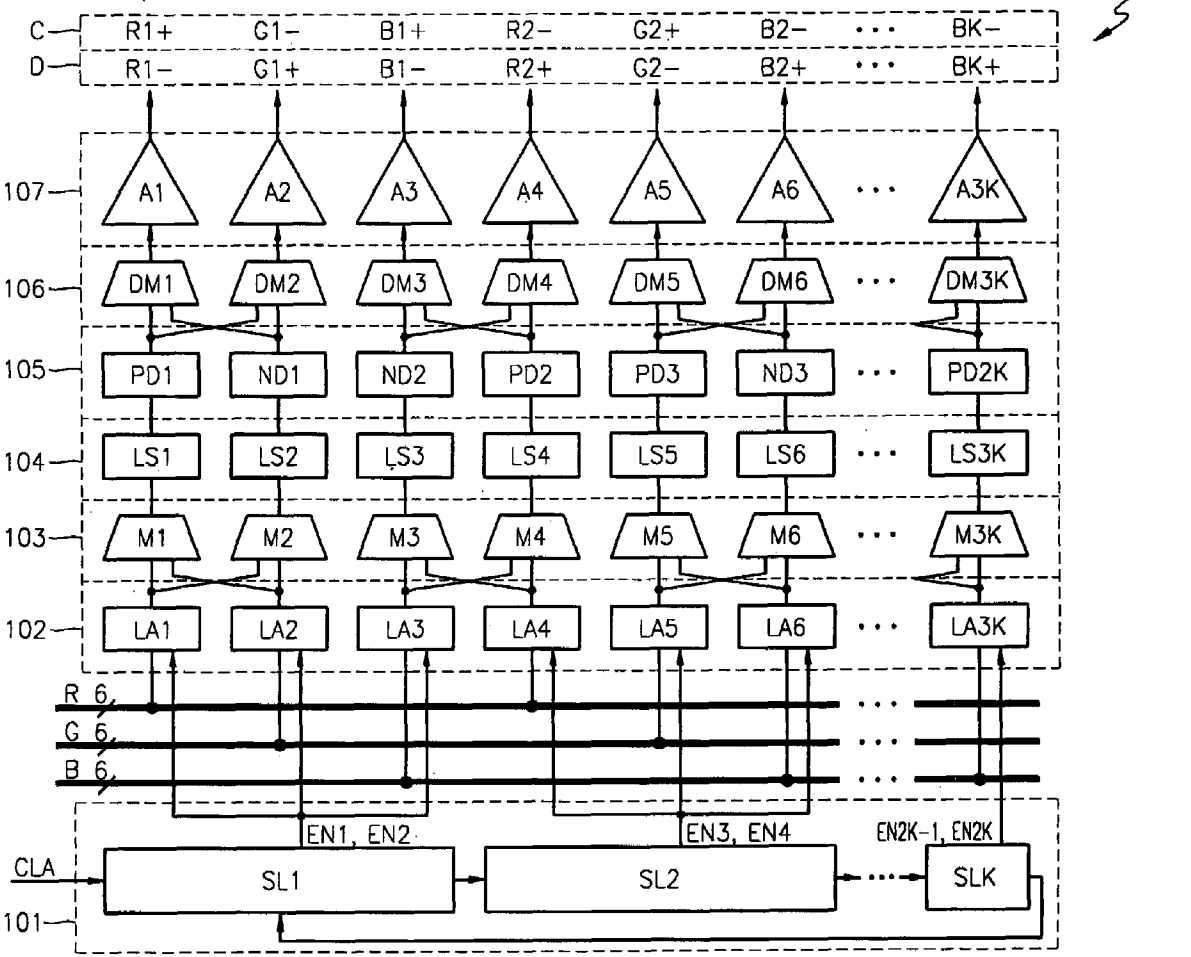
FIG. 2 (PRIOR ART)
FIG. 2 is a block diagram illustrating a conventional source driving circuit for a typical liquid crystal display (LCD) such as in FIG. 1.

Hereinafter, preferred embodiments of the present invention will be described in detail with reference to the accompanying drawings. The same reference numerals represent the same elements throughout the drawings.

Figure 4:
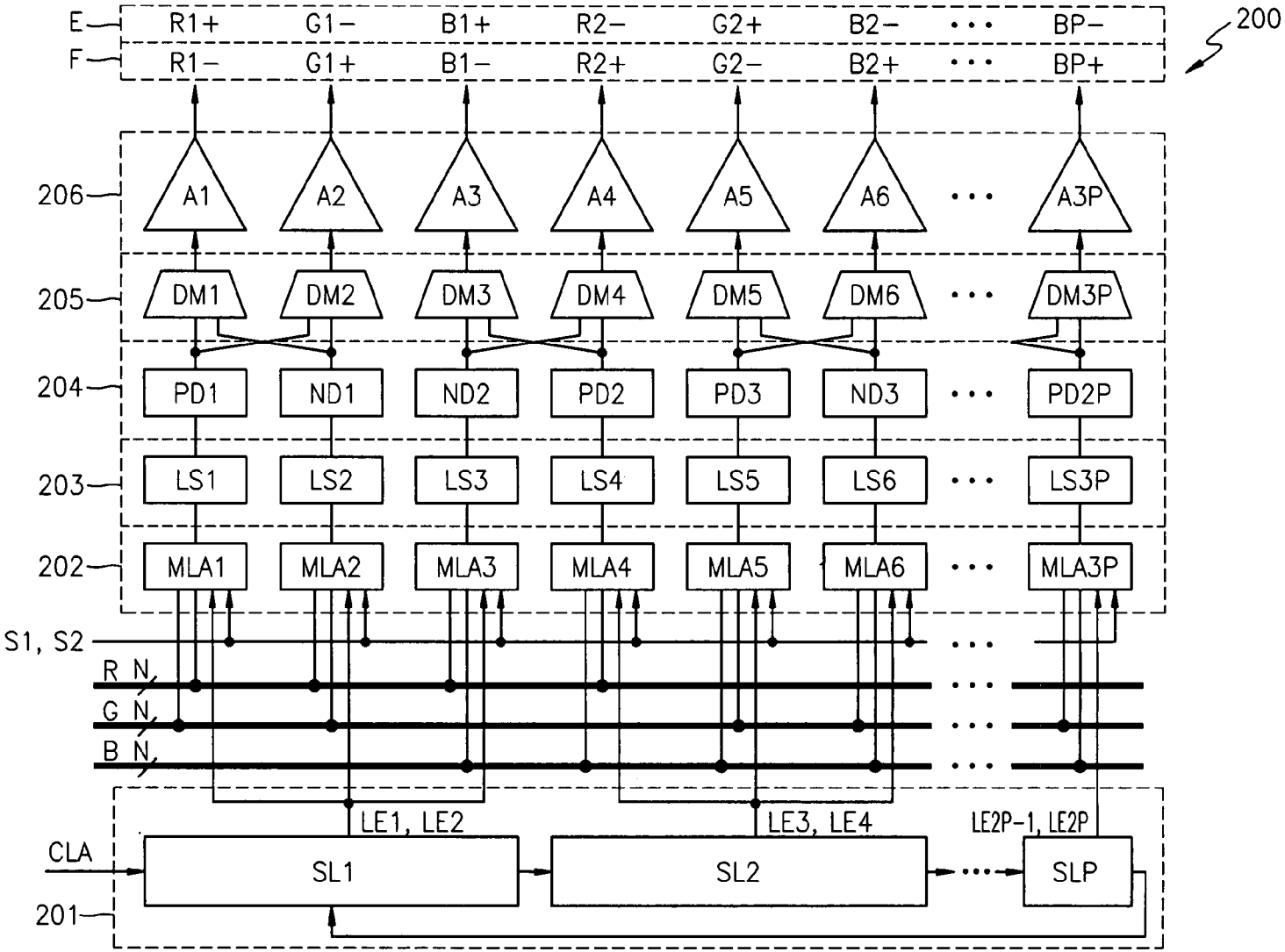
FIG. 4 is a block diagram illustrating a source driving circuit for an LCD according to a preferred embodiment of the present invention.

FIG. 4 is a block diagram illustrating a source driving circuit 200 for a liquid crystal display (LCD) according to a preferred embodiment of the present invention. Referring to FIG. 4, the source driving circuit 200 includes a shift register unit 201, a multiplexing-latch circuit unit 202, a level shifter unit 203, a decoding unit 204, a multiplexor (MUX) circuit unit 205, and an amplifying unit 206.

The shift register unit 201 includes a plurality of shift registers (SL1 through SLP), receives a latch signal CLA from the control circuit 14 shown in FIG. 1, and outputs a plurality of latch signals LE1 through LE2P (P is a natural number more than 1).

The multiplexing-latch circuit unit 202 latches digital image signals (e.g., R G B) in response to selection signals S1 and S2 and the plurality of latch signals LE1 through LE2P. The digital image signals are N-bit color signals R, G, B. The multiplexing latch circuit unit 202 includes a plurality of multiplexing-latch circuits MLA1 through MLA3P that each latch one bit of one of the N-bit color signals R, G, B, respectively (N is a natural number more than 1). Here, each of the respective plurality of multiplexing-latch circuits MLA1 through MLA3P latch a dynamically selected one of two digital image signals that are input to each multiplexing-latch circuit, in response to the selection signals S1 and S2 and the plurality of latch signals LE1 through LE2P.

For example, during LCD operation each multiplexing-latch of a paired set of multiplexing-latch circuits (e.g., MLA1 and MLA2) latch one bit of one of two digital image signals (e.g., the digital image signals R and G) in response to the selection signals S1 and S2 and the latch signals LE1 and LE2. For instance, when the multiplexing-latch circuit MLA1 latches one bit of the digital image signal R, the multiplexing-latch circuit MLA2 latches one bit of the signal G, and vice versa.

The respective multiplexing-latch circuits MLA3 and MLA4 latch one of the signals B, R in response to the selection signals S1 and S2 and the latch signals LE1 through LE4. The multiplexing-latch circuits MLA3 and MLA4 latch one bit of different digital image signals at any given time. For instance, when the multiplexing-latch circuit MLA3 latches one bit of the digital image signal B, the multiplexing-latch circuit MLA4 latches one bit of the digital image signal R, and vice versa.

The respective multiplexing-latch circuits MLA5 and MLA6 latch one bit of one of the digital image signals G, B in response to the selection signals S1 and S2 and the latch signals LE3 and LE4. The multiplexing-latch circuits MLA5 and MLA6 latch bits of different digital image signals at any given time. For instance, when the multiplexing-latch circuit MLA5 latches one bit of the digital image signal G, the multiplexing-latch circuit MLA6 latches one bit of the digital image signal B, and vice versa.

Therefore, the plurality of multiplexing-latch circuits MLA1 through MLA3P can be divided into three groups of two multiplexing-latch circuits wherein each group (pair) latches two color signals, i.e., signals R, G, signals B, R, and signals G, B, respectively.

The level shifter unit 203 includes a plurality of level shifters LS1 through LS3P. The plurality of level shifters LS1 through LS3P increase the logic voltage levels of the digital image signals R, G, B latched by the plurality of latch circuits MLA1 through MLA3P and output the N-bit digital image signals R, G, B so that their logic voltage levels fall within a voltage range that can be recognized by the decoding unit 204.

The decoding unit 204 includes a plurality of first decoders PD1 through PD2P and a plurality of second decoders ND1 through ND2P. The plurality of first decoders PD1 through PD2P and the plurality of second decoders ND1 through ND2P are alternately arranged by twos, respectively, as shown in FIG. 4. In detail, first and last decoders PD1 and PD2P are formed in the decoding unit 204, and the first decoders PD2 through PD2P-1 and the second decoders ND1 through ND2P are arranged alternately by twos between the first and last decoders PD1 and PD2P, respectively. 64-level first reference voltages (not shown) having positive (+) polarities (relative to a common reference voltage) are applied to the plurality of first decoders PD1 through PD2P, and 64-level second reference voltages (not shown) having negative (−) polarities (relative to the common reference voltage) are applied to the plurality of second decoders ND1 through ND2P.

The plurality of first decoders PD1 through PD2P select and output one of the 64-level first reference voltages having the positive (+) polarities in response to the N-bit signals R, G, B received from the plurality of level shifters LS1 through LS3P. The plurality of second decoders ND1 through ND2P select and output one of the 64-level second reference voltages having the negative (−) polarities in response to the N-bit signals R, G, B received from the plurality of level shifters LS1 through LS3P. Therefore, analog image signals R1G1B1 through RPGPBP are output from the first decoders PD1 through PD2P and the second decoders ND1 through ND2P.

The amplifying unit 206 includes a plurality of amplifying circuits A1 through A3P. The plurality of amplifying circuits A1 through A3P increase and output the magnitude of electric currents of the output analog image signals R1G1B1 through RPGPBP while maintaining the output voltages levels of the analog image signals R1G1B1 through RPGPBP.

Here, a first source vertical channel is formed with a plurality of multiplexing latch circuits, a plurality of level shifters, a first decoder, a MUX circuit, and an amplifying circuit, and a second source vertical channel is formed with a plurality of multiplexing latch circuits, a plurality of level shifters, a second decoder, a MUX circuit, and an amplifying circuit. In the source driving circuit 200, the first and second source vertical channels are alternately arranged by twos (positive/negative), respectively.

In FIG. 4, as shown in dotted line blocks E and F, the polarities of the analog image signals R1G1B1 through RPGPBP that are finally output from the source driving circuit 200 have positionally alternating polarities.

Figure 5:
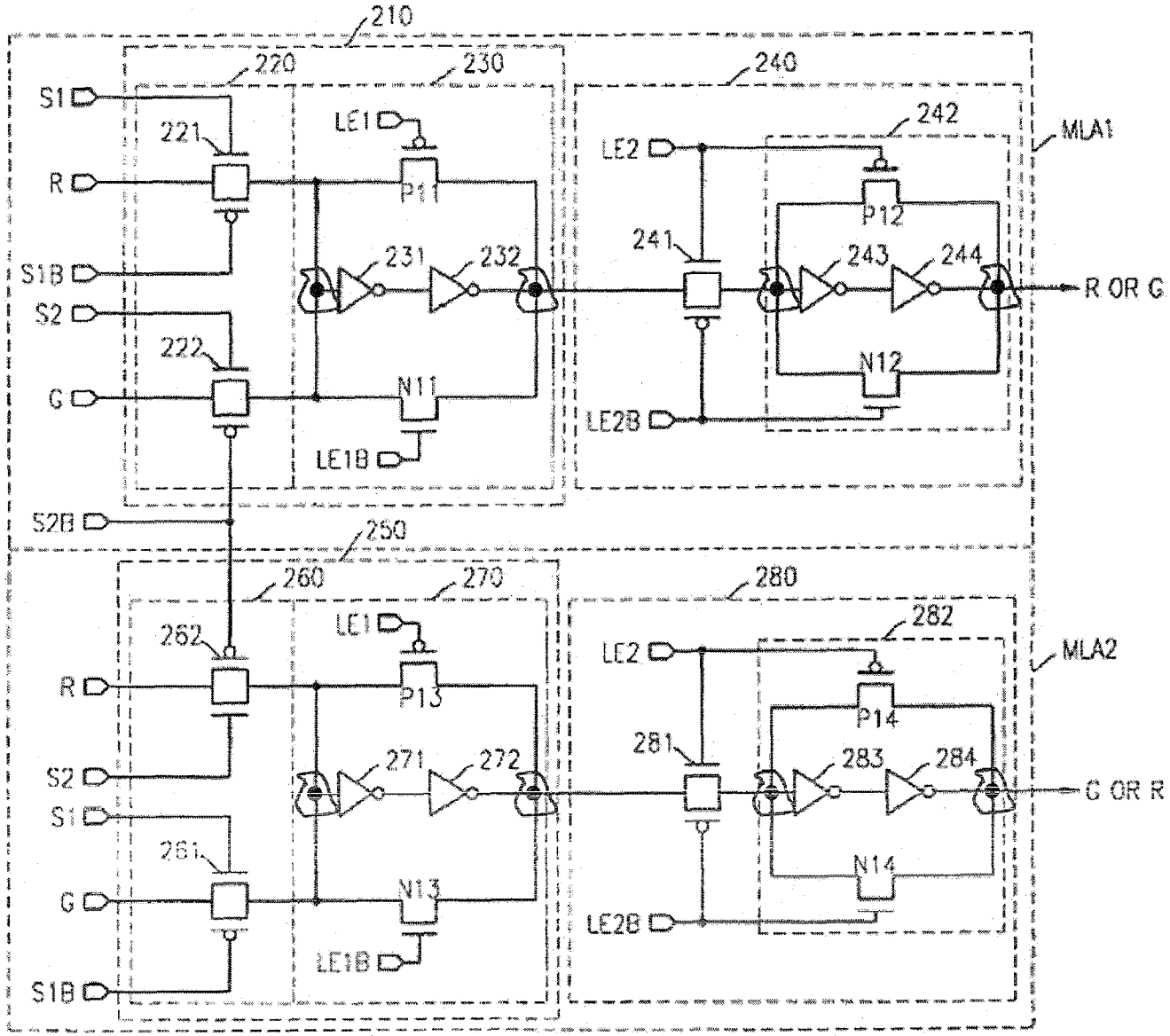
FIG. 5 is a detailed circuit diagram illustrating multiplexing-latch circuits shown in FIG. 4.

FIG. 5 is a detailed circuit diagram of the latch circuits MLA1 and MLA2 from the first two source vertical channels shown in FIG. 4.

Referring to FIG. 5, the multiplexing-latch circuit MLA1 includes a first (Master) latch circuit 210 and a second (Slave) latch circuit 240 that are operatively connected to each other (in a Master-Slave arrangement). The multiplexing-latch circuit MLA2 includes a first latch circuit 250 and a second latch circuit 280 that are connected to each other (in a Master-Slave arrangement).

Each of the multiplexing-latch circuits MLA1 and MLA2 include two latch circuits to latch both current digital image data that are to be displayed presently and successive digital image data that are to be displayed later.

The first (Master) latch circuit 210 includes a gate unit 220 and a latch unit 230. The gate unit 220 includes a plurality of transmission gates 221 and 222, and the latch unit 230 includes inverters 231 and 232, a PMOS transistor P11, and an NMOS transistor N11.

The transmission gate 221 receives and outputs a signal R in response to predetermined first selection signals S1 and S1B. The transmission gate 222 receives and outputs a signal G in response to predetermined second selection signals S2 and S2B.

Here, the first and second selection signals S1, S1B, S2, and S2B are generated by control circuits (not shown).

Output terminals of the transmission gates 221 and 222 are connected to the input of inverter 231, and the input of "keeper" inverter 232 is connected to the output of inverter 231. PMOS transistor P11 and NMOS transistor N11 form a third transmission gate controlled by Latch signal complement pair LE1 and LE1B for gating the feedback signal output from inverter 232 to the input of inverter 231. Thus, the first (Master) latch circuit 210 may be characterized as including a three-input multiplexor wherein one of the inputs is a feedback signal from a feedback ("keeper") inverter (inverter 232). A source of the PMOS transistor P11 and a drain of the NMOS transistor N11 are connected to an input terminal of the inverter 231, and a drain of the PMOS transistor P11 and a source of the NMOS transistor N11 are connected to an output terminal of the inverter 232. Also, a latch signal LE1 is input to a gate of the PMOS transistor P11 and a latch signal LE1B is input to a gate of the NMOS transistor N11.

The second (Slave) latch circuit 240 includes a transmission gate 241 and a latch unit 242. The latch unit 242 includes inverters 243 and 244, a PMOS transistor P12, and an NMOS transistor N12. PMOS transistor P12 and NMOS transistor N12 form a transmission gate controlled by Latch signal complement pair LE2 and LE2B for gating the feedback signal output from inverter 244 to the input of inverter 243. Thus, the second (Slave) latch circuit 240 may be characterized as including a two-input multiplexor wherein one of the inputs is a feedback signal from a feedback ("keeper") inverter (244).

A latch signal LE2 is input to gates of an NMOS transistor of the transmission gate 241 and a PMOS transistor P12 of the latch unit 242. Also, a latch signal LE2B is input to gates of a PMOS transistor of the transmission gate 241 and the NMOS transistor N12 of the latch unit 242. An output terminal of the transmission gate 241 is connected to the input of inverter 243 and the input of feedback ("keeper") inverter 244 is connected to the output of inverter 243.

A source of the PMOS transistor P12 and a drain of the NMOS transistor N12 are connected to an input terminal of the inverter 243, and a drain of the PMOS transistor P12 and a source of the NMOS transistor N12 are connected to an output terminal of the feedback inverter 244.

The first (Master) latch circuit 250 of the multiplexing-latch circuit MLA2 includes a gate unit 260 and a latch unit 270. The gate unit 260 includes a plurality of transmission gates 261 and 262, and the latch unit 270 includes inverters 271 and 272, a PMOS transistor P13, and an NMOS transistor N13.

The transmission gate 262 receives and outputs the signal R in response to the second selection signals S2 and S2B. The transmission gate 261 receives and outputs the signal G in response to the first selections signals S1 and S1B.

The constructions of the latch unit 270 and the second latch unit 280 are equivalent to those of the latch unit 230 and the second latch circuit 240, and therefore, their detailed descriptions will be omitted here.

The operations of a latch circuit according to a preferred embodiment of the present invention will now be described with reference to FIG. 5.

When the first selection signals S1 and S1B are enabled, the transmission gates 221 and 261 are turned ON (and transmission gates 222 and 262 are turned OFF). When the second selection signals S2 and S2B are enabled, the transmission gates 222 and 262 are turned on (and the transmission gates 221 and 261 are turned OFF).

In this disclosure, a case where the second selection signals S2 and S2B are enabled and the first selection signals S1 and S1B are disabled will be described.

First, the second selection signals S2 and S2B are enabled and the latch signals LE1 and LE1B are enabled. In the response to the second selection signal S2 and S2B being enabled, the transmission gate 222 is turned ON to output the digital image signal G and the transmission gate 262 is turned ON to output the digital image signal R.

While the latch signals LE1 and LE1B are enabled, the latch unit 230 latches the digital image signal G and the latch unit 270 latches the digital image signal R. Then, the second selection signals S2 and S2B are disabled, the transmission gates 222 and 262 are turned OFF.

Next, the latch signals LE2 and LE2B are enabled, the latch signals LE1 and LE1B are disabled. In response to the latch signals LE1 and LE1B being disabled, the PMOS transistors P11 and P13 and the NMOS transistors N11 and N13 of the e latch units 230 and 270 are turned OFF. The transmission gates 241 and 281 are turned ON in response to the latch signals LE2 and LE2B being enabled.

The transmission gate 241 receives and outputs the digital image signal G from the latch unit 230, and the transmission gate 281 receives and outputs the digital Image signal R from the latch unit 270.

Next, when the latch signals LE2 and LE2B are disabled, the transmission gates 241 and 281 are turned off and PMOS transistors P12 and P14 and NMOS transistors N12 and N14 of the latch units 242 and 282 are turned on.

The latch unit 242 latches the digital image signal G input from the transmission gate 241; and the latch unit 282 latches the digital image signal R input from the transmission gate 281. Thereafter, the latch units 242 and 282 output the latched digital image signals G and R.

The operations of the latch circuits MLA1 and MLA2 when the first selection signals S1 and S1B are enabled and the second selection signals S2 and S2B are disabled, are similar to the operations of the latch circuits MLA1 and MLA2 when the second selection signals S2 and S2B are enabled and the first selection signals S1 and S1B are disabled, except that the latch circuit MLA1 outputs the signal R and the latch circuit MLA2 outputs the signal G for the latter case. Therefore, descriptions of the operations of the latch circuits MLA1 and MLA2 in this case will be omitted.

As described above, the source driving circuit 200 for an LCD, according to a preferred embodiment of the present invention, does not require additional MUX circuits since the latch circuits MLA1 and MLA2 have both latch circuit functions and MUX circuit functions. Thus, the area of source vertical channels occupied in the source driving circuit 200 is reduced, thereby enabling effective use of a semiconductor chip.

Meanwhile, as shown in FIG. 5, the source driving circuit 200 requires input of the selection signals S1, S1B, S2, and S2B that control the operations of the gate units 220 and 260. The selection signals S1, S1B, S2, and S2B are generated by control circuits, which are not illustrated in the drawings. The control circuits can be dispersively arranged within the semiconductor chip and thus do not assume a great-dedicated area of the semiconductor chip, unlike the source vertical channels with array structures, which assume a great dedicated area of the semiconductor chip.

Figure 3:
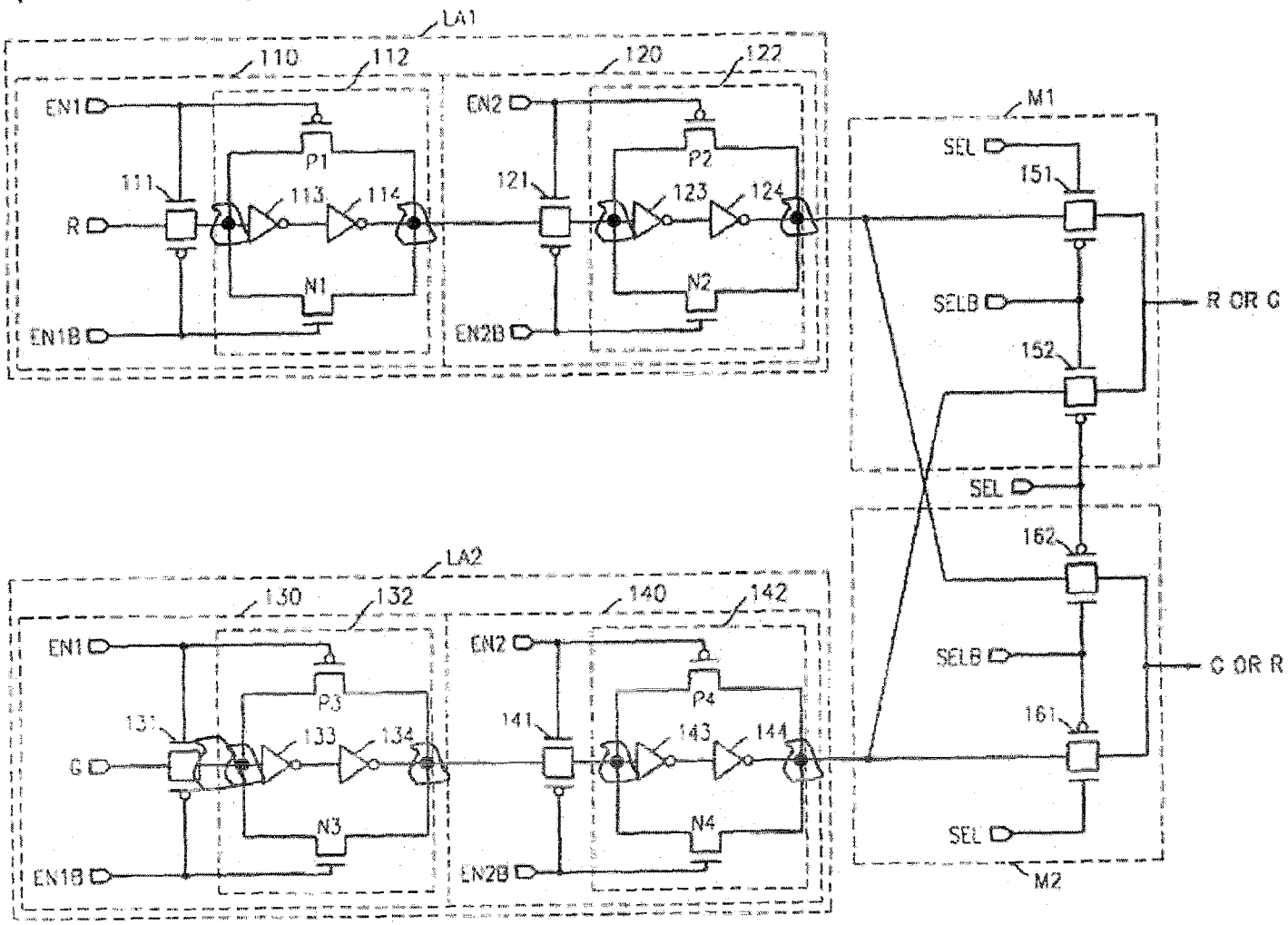
FIG. 3 (PRIOR ART)
FIG. 3 is a detailed circuit diagram illustrating the relationship between latch circuits and multiplexor (MUX) circuits in the source driving circuit of FIG. 2.

Further, turning ON or OFF of all of the transmission gates 111 and 131 and the latch units 112 and 132 in a conventional source driving circuit as shown in FIG. 3 are controlled only in response to the latch signals EN1B and EN1, whereas turning on or off of the gate units 220 and 260 in the source driving circuit 200 according to the present invention can be controlled in response to the selection signals S1, S1B, S2, and S2B. Therefore, according to the present invention, loads weighed on the latch signals LE1 and LE1B can be reduced.

In alternative embodiments of the invention that will be apparent to those skilled in the art, an output-buffering element (e.g., inverter, NAND GATE, NOR GATE) can be added to at least the first latch circuits (210 and 250) whereupon the size of the feedback inverters (232 and 272) can be reduced, and the latch signals LE1 and LE1B may be eliminated and transistors P11, N11, P13 and N13 may be removed (or reconnected to form the output-buffering inverter).

For example, the input of an output-buffering inverter may be connected to the output of inverter 231, and the output of the output-buffering inverter may be connected to the input of transmission gate 241. The weaker feedback inverter (232) is sized so as to "keep" the latched selected digital image signal stored in the first (Master) latch circuit 210 until the old stored value is overpowered by a new selected digital image signal input via one of transmission gates 221 and 222. Similarly, an output-buffering element (e.g., inverter) can be connected to the second latch circuit 240 to provide for the removal of transistors P12 and N12. In other alternative embodiments of the invention, such an output-buffering element (e.g., inverter) may be operatively connected to the output of the feedback inverter (232) instead of the output of inverter 231. In such alternative embodiments of the invention, the multiplexing-latch circuit (MLA1), or at least one of its included latch circuits (210 or 240) may store and/or output the logical complement of the selected one of the digital image signals that are input to the multiplexing-latch circuit.

In other alternative embodiments of the invention, the first (Master) latch circuit could be implemented as conventional latch circuit 110 (FIG. 3) while the second (Slave) latch circuit incorporates the two-external-signal multiplexing (MUX) function and structure of two-input latch circuit 210 of FIG. 5.

As described above, a source driving circuit for an LCD according to the present invention is capable of selectively latching input digital image signals using latch circuits that incorporate (external-signal multiplexing) MUX circuit functions, thus reducing the areas of source vertical channels in the semiconductor chip.

While this invention has been particularly shown and described with reference to preferred embodiments thereof, it will be understood by those skilled in the art that various changes in form and details may be made therein without departing from the spirit and scope of the invention as defined by the appended claims, wherein N is a natural number more than 1.

What is claimed is:

1. A source driving circuit for a liquid crystal display (LCD) for driving an LCD panel in response to digital image signals, the source driving circuit comprising:

a multiplexing-latch circuit adapted to select and latch and output one of a first and second digital image signals in response to first and second selection signals, wherein the multiplexing latch circuit comprises a plurality of inverters and transmission gates configured to form a first latch including a gate unit, and a second latch, wherein the gate unit includes first and second transmission gates, wherein the first latch includes the gate unit, and first and second inverters, wherein the second latch includes third and fourth inverters, wherein the output node of the first latch is connected to the input node of the third inverter through the fourth transmission gate, and the first and second transmission gates are directly connected to the input node of the first inverter.

2. The source driving circuit of claim 1, further comprising:

a second multiplexing-latch circuit having the same internal structure as the first multiplexing-latch circuit;

a plurality of level shifters for increasing logic voltage levels of the latched digital image signal data received from the first and second multiplexing-latch circuits and outputting the level shifted latched data;

a plurality of positive decoders, wherein each of the positive decoders is adapted to output a dynamically selected one of a plurality of positive reference voltages in response to the latched data received from the plurality of level shifters, each of the positive reference voltages having different voltage levels and positive polarities;

a plurality of negative decoders, wherein each of the negative decoders is adapted to output a dynamically selected one oaf plurality of negative reference voltages in response to the latched data received from the plurality of level shifters, the negative reference voltages having different voltage levels and negative polarities;

a plurality of multiplexor (MUX) circuits, wherein each of the MUX circuits is adapted to output a selected one of the positive and negative reference voltages as an analog image signal in response to a MUX selection signal; and a plurality of amplifiers adapted to increase the magnitude of electric current of the analog image signals output at the positive and negative reference voltages.

3. The source driving circuit of claim 2, further comprising a plurality of operatively connected pairs of first and second multiplexing-latch circuits, wherein the pairs are categorized into three groups, wherein each group is adapted to latch a predetermined pair of color signals selected from: R and G color signals B and R color signals, and G and B color signals.

4. The source driving circuit of claim 1, wherein the first selection signal is disabled when the second selection signal is enabled.

5. The source driving circuit of claim 4, wherein the first and second selection signals are enabled or disabled in response to a polarity signal that is one of a plurality of control signals output from a control circuit.

6. The source driving circuit of claim 1, wherein each of the inverters comprises two complementary field-effect transistors (FETs) connected in series and wherein each of the transmission gates comprises two complementary FETs connected in parallel.

7. A source driving circuit for a liquid crystal display (LCD) that drives an LCD panel in response to digital image signals, the source driving circuit comprising:

a plurality of pairs of first and second multiplexing-latch circuits, wherein each of the first and second multiplexing-latch circuits is adapted to select and latch and output one of a first and second digital image signals in response to first and second selection signals, wherein each of the first and second multiplexing-latch circuits includes a master latch circuit and a corresponding slave latch circuit and is configured to function as a master-slave latch adapted to select and latch one of a first and second digital image signals, wherein the master latch circuit of each multiplexing-latch circuit includes a gate unit, a first inverter and a second inverter, wherein the gate unit includes first and second transmission gates, wherein each of the first and second transmission gates is connected to the input node of the first inverter of the master latch circuit and is configured to pass a predetermined one of the first and second digital image signals to the input node of the first inverter of the master latch circuit, in response to one of the first and second selection signals being enabled.

8. The source driving circuit of claim 7, wherein the output node of the second inverter of the master latch circuit is the output node of the master latch circuit.

9. The source driving circuit of claim 8, wherein the slave latch circuit of each multiplexing-latch circuit includes two inverters.

10. The source driving circuit of claim 7, wherein the first selection signal is disabled when the second selection signal is enabled, and the second selection signal is disabled when the first selection signal is enabled.

11. The source driving circuit of claim 7, wherein wherein the master latch circuit of each multiplexing-latch circuit further includes a third transmission gate wherein the third transmission gate is a feedback transmission gate connected between the output node of the second inverter of the master latch circuit and the input node of the first inverter of the master latch circuit, wherein the second inverter of the master latch circuit is a feedback inverter, wherein the input node of the second inverter is connected directly to the output node of the first inverter, and the output node of the second inverter is connected, through third transmission gate, to the input node of the first inverter.

12. The source driving circuit of claim 11, wherein each of the first and second transmission gates is adapted to pass a predetermined one of the first and second digital image signals directly to the input node of the first inverter of the master latch circuit in response to one of the first and second selection signals being enabled.

13. The source driving circuit of claim 12, wherein wherein each of the first and second multiplexing-latch circuits includes no more than five transmission gates and no more than four inverters.

14. The source driving circuit of claim 13, wherein each of the first and second multiplexing-latch circuits includes no more than 18 field effect transistors.

15. An article of manufacture comprising:

a master-slave latch circuit adapted to dynamically select and to latch one of a first and second externally supplied independent voltage signals and to output one of the first and second voltage signals, wherein the master-slave latch circuit includes a master latch circuit and a corresponding slave latch circuit, wherein the master latch circuit includes a gate unit, a first inverter and a second inverter, wherein the gate unit includes first and second transmission gates, each of the first and second transmission gates is connected to the input node of the first inverter of the master latch circuit and is configured to pass a predetermined one of the first and second digital image signals to the input node of the first inverter of the master latch circuit, in response to one of the first and second selection signals being enabled.

16. The article of claim 15, wherein the master-slave latch circuit includes no more than five transmission gates and no more than four inverters.

* * * * *